US008395063B2

(12) United States Patent
Lagiewka et al.

(10) Patent No.: US 8,395,063 B2
(45) Date of Patent: Mar. 12, 2013

(54) LOCKING DEVICE FOR USE WITH A CIRCUIT BREAKER AND METHOD OF ASSEMBLY

(75) Inventors: Marcin Piotr Lagiewka, Bielsko-Biala (PL); Jacek Stanislaw Mrowiec, Bielsko-Biala (PL); Przemyslaw Eugeniusz Cieply, Bielsko-Biala (PL)

(73) Assignee: General Electric Company, Schenectady, NY (US)

( * ) Notice: Subject to any disclaimer, the term of this patent is extended or adjusted under 35 U.S.C. 154(b) by 190 days.

(21) Appl. No.: 12/980,888

(22) Filed: Dec. 29, 2010

(65) Prior Publication Data

US 2012/0168286 A1 Jul. 5, 2012

(51) Int. Cl.
*H01H 9/28* (2006.01)

(52) U.S. Cl. ..... 200/43.11; 200/401

(58) Field of Classification Search ..... 200/43.11, 200/43.14, 43.16, 43.19, 43.21, 334
See application file for complete search history.

(56) References Cited

U.S. PATENT DOCUMENTS

| | | | | |
|---|---|---|---|---|
| 5,256,838 | A | 10/1993 | Benda | |
| 5,466,903 | A | 11/1995 | Faber | |
| 5,828,277 | A | 10/1998 | Duchemin | |
| 6,545,234 | B1 | 4/2003 | Trivette et al. | |
| 7,038,155 | B2 * | 5/2006 | Ahlert et al. | 200/400 |
| 7,115,830 | B1 | 10/2006 | Weister et al. | |
| 2009/0189719 | A1 | 7/2009 | Yang | |
| 2009/0206964 | A1 | 8/2009 | Holland | |

FOREIGN PATENT DOCUMENTS

| | | | |
|---|---|---|---|
| GB | 1550485 | A | 8/1979 |
| WO | 2009097148 | A1 | 8/2009 |
| WO | 2009105226 | A1 | 8/2009 |

OTHER PUBLICATIONS

Search Report and Written Opinion from corresponding EP Application No. 11194081.3-2214 dated Jul. 23, 2012.

* cited by examiner

*Primary Examiner* — Renee Luebke
*Assistant Examiner* — Lheiren Mae Caroc
(74) *Attorney, Agent, or Firm* — Global Patent Operation

(57) ABSTRACT

A circuit protection device includes a circuit breaker having a first contact arm and a second contact arm, wherein the second contact arm is configured to move with respect to the first contact arm between a first position and a second position. The circuit protection device also includes a locking device coupled to the circuit breaker, wherein the locking device is configured to at least one of move the second contact arm from the first position to the second position and lock the second contact arm in the second position.

19 Claims, 8 Drawing Sheets

LOCKING DEVICE FOR USE WITH A CIRCUIT BREAKER AND METHOD OF ASSEMBLY

BACKGROUND OF THE INVENTION

The embodiments described herein relate generally to circuit breakers and, more particularly, to devices that enable locking of circuit breakers in a tripped position and enable tripping of circuit breakers.

At least some known circuit breakers include an interlock and an auxiliary latch, wherein the interlock prevents the auxiliary latch from re-engaging after the circuit breaker has tripped due to detection of a tripping criteria, such as an overcurrent detection. For example, the interlock prevents the auxiliary latch from re-engaging until the circuit breaker is manually reset. Moreover, at least some known circuit breakers include a handle that enables a user, such as service personnel, to manually separate primary electrical contacts within the circuit breaker. The handle is coupled to secondary electrical contacts that provide power to the handle such that, when a preselected condition is detected and when the handle is in an "on" position, the primary electrical contacts are reconnected to enable current to flow through the circuit breaker. However, such known circuit breakers do not enable a circuit breaker to be manually tripped and locked in the tripped or open position using an externally-located arm or lever.

BRIEF DESCRIPTION OF THE INVENTION

In one aspect, a circuit protection device includes a circuit breaker having a first contact arm and a second contact arm, wherein the second contact arm is configured to move with respect to the first contact arm between a first position and a second position. The circuit protection device also includes a locking device coupled to the circuit breaker, wherein the locking device is configured to move the second contact arm from the first position to the second position and/or lock the second contact arm in the second position.

In another aspect, a locking device is provided for use with a circuit breaker that includes at least one movable contact arm configured to move between a first position and a second position. The locking device includes a housing comprising an opening extending therethrough, and a rotor configured to be coupled to the housing and to the circuit breaker, wherein the rotor configured to rotate about an axis. The locking device also includes a locking arm extending through the opening and coupled to the rotor such that an actuating force on the locking arm causes the at least one contact arm to be locked in the second position and/or move from the first position to the second position.

In another aspect, a method of assembling a circuit protection device is provided, wherein the circuit protection device includes a circuit breaker having a first contact arm and a second contact arm that is configured to move with respect to the first contact arm between a first position and a second position. The method includes coupling a locking device to the circuit breaker, wherein the locking device is configured to cause the second contact arm to move from the first position to the second position and/or lock the second contact arm in the second position.

DETAILED DESCRIPTION

Exemplary embodiments of apparatus and methods for use with circuit breakers are described herein. These embodiments provide a mechanical device that is accessible from outside of a circuit breaker. Moreover, these embodiments facilitate preventing the circuit breaker contacts from touching each other and facilitate causing the circuit breaker contacts to separate from a closed position. More specifically, the circuit breaker contacts can be locked in an open position or a trip of the circuit breaker can be initiated, wherein the contacts are moved from a closed position to the open position. When the contacts are locked in an open position, a contact arm can begin a closing operation but is prevented from completing the closing operation. For example, the contact arm begins a movement from an open position to a closed position but is prevented from completing the movement and returns to the open position. These locking and tripping operations provide greater safety to service personnel during maintenance operations. Moreover, the embodiments described herein can be used with an automated actuating device that causes the circuit breaker to lock or to initiate a trip based on a mechanical signal.

Figure 1:
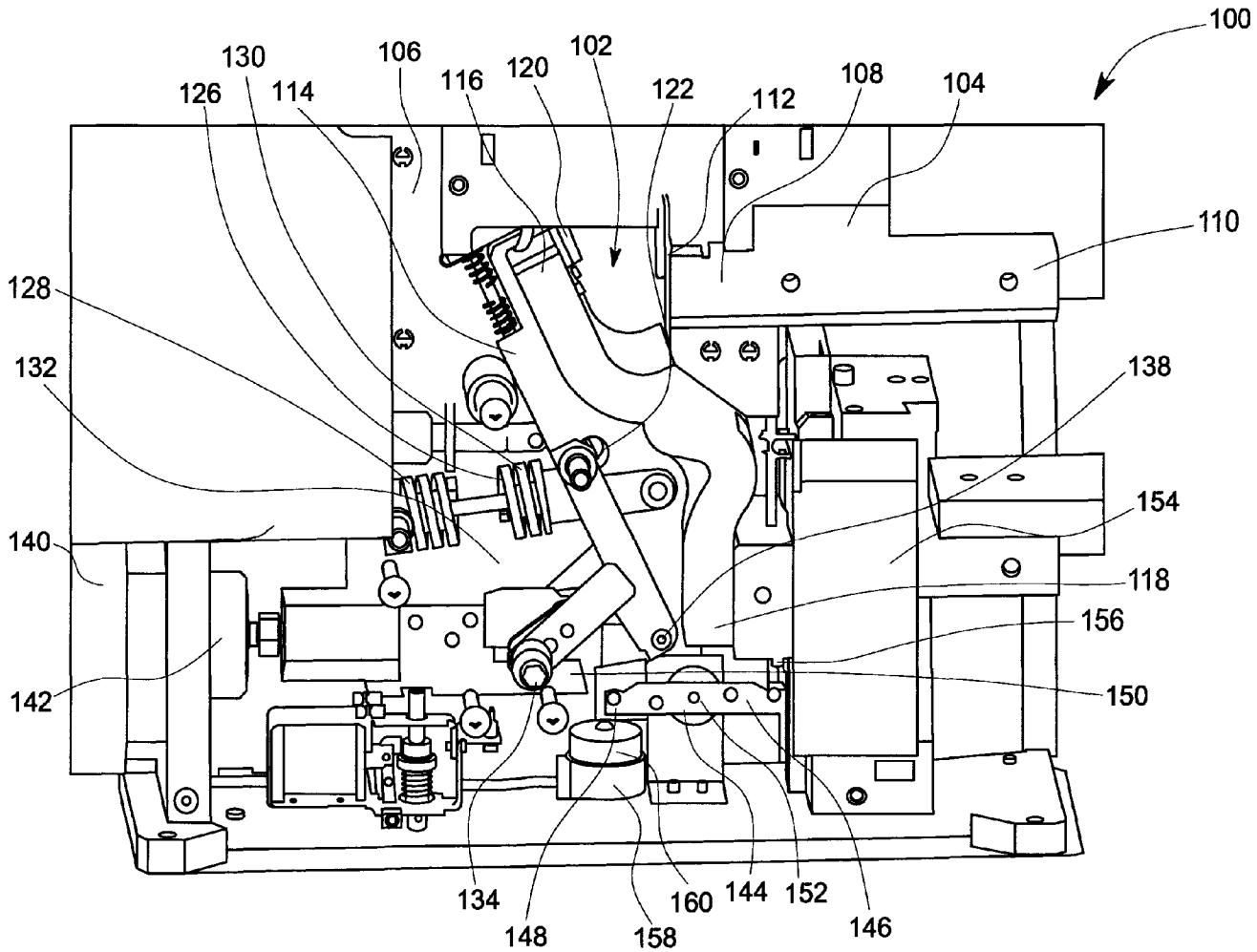
FIG. 1 is a side view of an exemplary circuit breaker in an open or tripped state.
Figure 2:
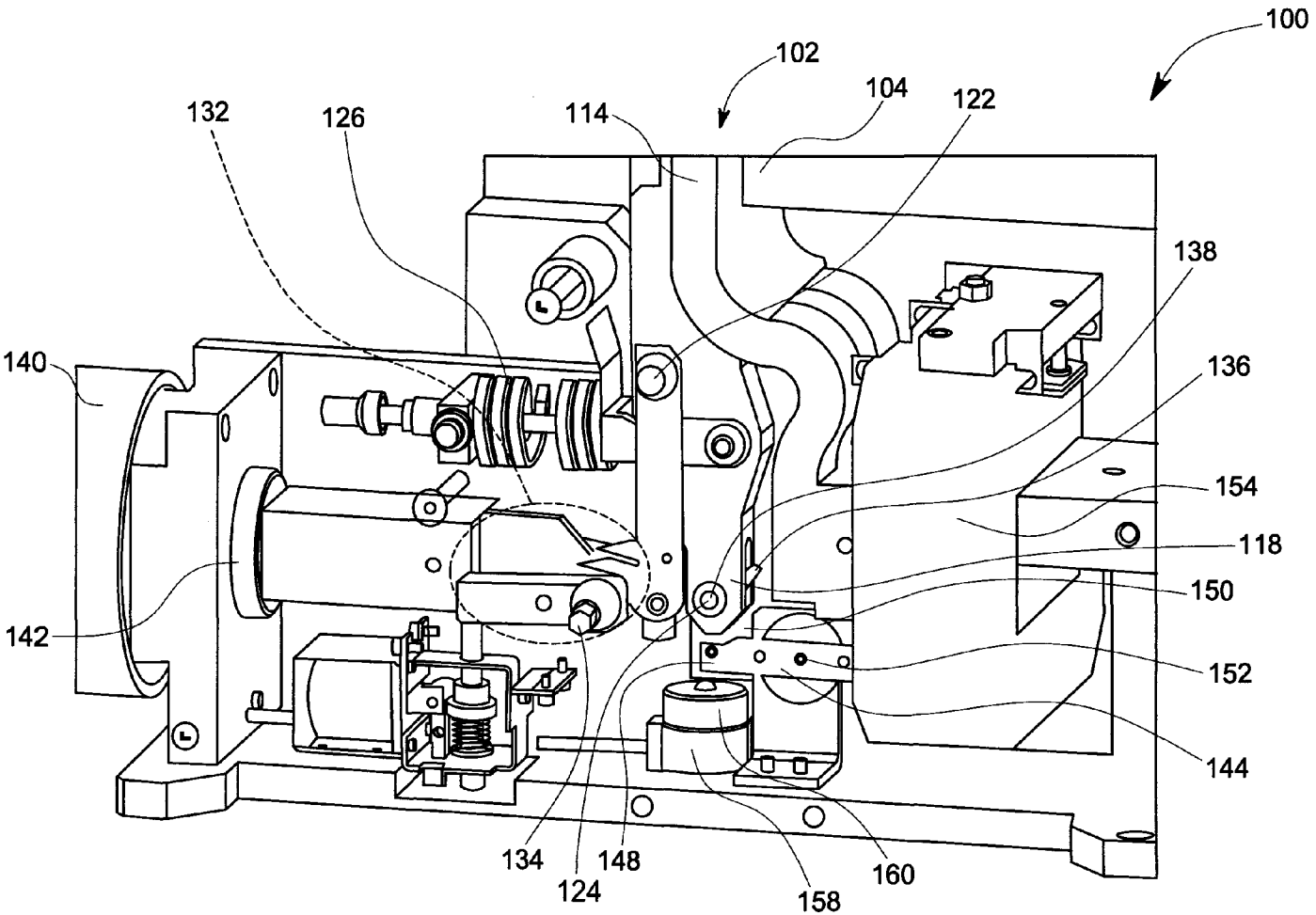
FIG. 2 is a side view of the circuit breaker shown in FIG. 1 in a closed or active state.

FIG. 1 is a side view of an exemplary circuit protection device 100 in an open or tripped state, and FIG. 2 is a side view of circuit protection device 100 in a closed or active state. In an exemplary embodiment, circuit protection device 100 includes a circuit breaker 102 having a first contact arm 104 that is coupled, such as fixedly coupled, to a frame 106 of circuit breaker 102. First contact arm 104 includes a first end 108 and an opposite second end 110. First end 108 includes a first electrically conductive contact 112. Circuit breaker 102 also includes a second contact arm 114 that is movable with respect to first contact arm 104 between a first position and a second position. For example, second contact arm 114 is in the first position when circuit breaker 102 is in the closed state and is in the second position when circuit breaker 102 is in the open state. Second contact arm 114 includes a first end 116 and an opposite second end 118. First end 116 includes a second electrically conductive contact 120 that conducts electrical energy to first conductive contact 112. Moreover, second contact arm 114 rotates about a first pivot point 122 such that first and second conductive contacts 112 and 120 contact each other in the first position and are spaced apart from each other in the second position. Second contact arm 114 also includes a latch bolt 124 that facilitates locking second contact arm 114 in the second position as described below.

In an exemplary embodiment, circuit breaker 102 also includes a compression element 126, such as a spring. Compression element 126 includes a first end 128 and an opposite second end 130. First end 128 is coupled to frame 106. Second end 130 is coupled to second contact arm 114 to facilitate moving second contact arm 114 between the first and second positions. Moreover, a first latch 132 is coupled to frame 106 and to second contact arm 114. First latch 132 is moveable between a latched position and an unlatched position about a second pivot point 134. Circuit breaker 102 also includes a second latch 136 that, in an exemplary embodiment, is coupled to first latch 132 at a third pivot point 138. Second latch 136 rotates about third pivot point 138 to engage with and disengage from latch bolt 124 as described below. More specifically, first latch 132 is coupled to second contact arm 114 at third pivot point 138 by means of second latch 136 and latch bolt 124.

Furthermore, in an exemplary embodiment, circuit breaker 102 includes a solenoid 140 that is coupled to frame 106. Solenoid 140 includes a linkage 142 that is coupled to first latch 132. Linkage 142 causes first latch 132 to rotate about second pivot point 134 to the latched and unlatched positions. Circuit breaker 102 also includes a lever 144 that is coupled to frame 106. Lever 144 includes a first end 146 and a second end 148. A tripping block 150 is provided at second end 148 to enable second latch 136 to disengage with latch bolt 124. Specifically, lever 144 rotates about a fourth pivot point 152 such that tripping block 150 enables second latch 136 to engage and disengage with latch bolt 124.

Circuit breaker 102 also includes an overcurrent trip unit 154 coupled to frame 106. Trip unit 154 includes a current sensor (not shown) that measures current through a conductor. Trip unit 154 determines whether the measured current is higher than a preselected threshold. When trip unit 154 detects an overcurrent, trip unit 154 causes a tripping rod 156 to engage with lever first end 146. For example, the tripping rod induces a downward force on first end 146, which causes lever 144 to rotate about fourth pivot point 152. The rotation of lever 144 causes tripping block 150 to cause second latch 136 to disengage from latch bolt 124. This enables compression element 126 to cause second contact arm 114 to move away from first contact arm 104. In an exemplary embodiment, circuit breaker 102 also includes an impulse trip device 158 that includes an impulse coil 160 and a projection 162 that is movably coupled to impulse coil 160. Impulse coil 160 receives a signal from, for example, an external controller or other electronic source, and causes projection 162 to move upward along a pin or rod to induce an upward force on lever second end 148. More specifically, projection 162 causes lever 144 to rotate about fourth pivot point 152, which causes second latch 136 to disengage from latch bolt 124. This enables compression element 126 to cause second contact arm 114 to move away from first contact arm 104.

As shown in FIG. 1, first contact arm 104 and second contact arm 114 are maintained in the open state by a force generated by compression element 126. Moreover, first latch 132 is maintained in an unlatched position by solenoid 140. Specifically, solenoid 140 induces a force on first latch 132 via linkage 142 to maintain first latch 132 in the unlatched position when first and second contact arms 104 and 114 are in the open state. In addition, when first and second contact arms 104 and 114 are in the open state, second latch 136 is engaged with latch bolt 124. Moreover, lever 144 is maintained in a neutral state that enables second latch 136 to remain engaged with latch bolt 124.

In order to reposition first and second contact arms 104 and 114 into the closed state, solenoid 140 causes linkage 142 to move linearly toward solenoid 140. The linear motion of linkage 142 causes first latch 132 to rotate about second pivot point 134 from an unlatch position to a latched position. The rotation of first latch 132 causes second contact arm 114 to move towards first contact arm 104 until first and second conductive contacts 112 and 120 meet. Second latch 136 remains engaged with latch bolt 124, and lever 144 remains in the neutral state.

As shown in FIG. 2, first contact arm 104 and second contact arm 114 are maintained in the closed state by the engagement of second latch 136 with latch bolt 124. Moreover, a contact force between first and second conductive contacts 112 and 120 is maintained by compression element 126. When first contact arm 104 and second contact arm 114 are in the closed state, lever 144 remains in the neutral state.

In order to reposition first and second contact arms 104 and 114 into the open state, such as when the current sensor determines that the measured current is greater than the threshold current, tripping rod 156 of trip unit 154 moves downward and induces a force on lever first end 146, which causes lever 144 to rotate about fourth pivot point 152. Rotation of lever 144 causes tripping block 150 to induce a force on second latch 136, thereby causing second latch 136 to disengage from latch bolt 124. When second latch 136 and latch bolt 124 have disengaged, compression element 126 causes second contact arm 114 to move away from first contact arm 104. This motion causes first and second conductive contacts 112 and 120 to separate, thereby breaking the electrical connection between them such that current can no longer flow through circuit breaker 102. Alternatively, when impulse coil 160 receives a trip signal, impulse coil 160 causes projection 162 to move upward along a pin or rod to induce an upward force on lever second end 148. More specifically, projection 160 causes lever 144 to rotate about fourth pivot point 152, which causes second latch 136 to disengage from latch bolt 124. This enables compression element 126 to cause second contact arm 114 to move away from first contact arm 104.

Figure 3:
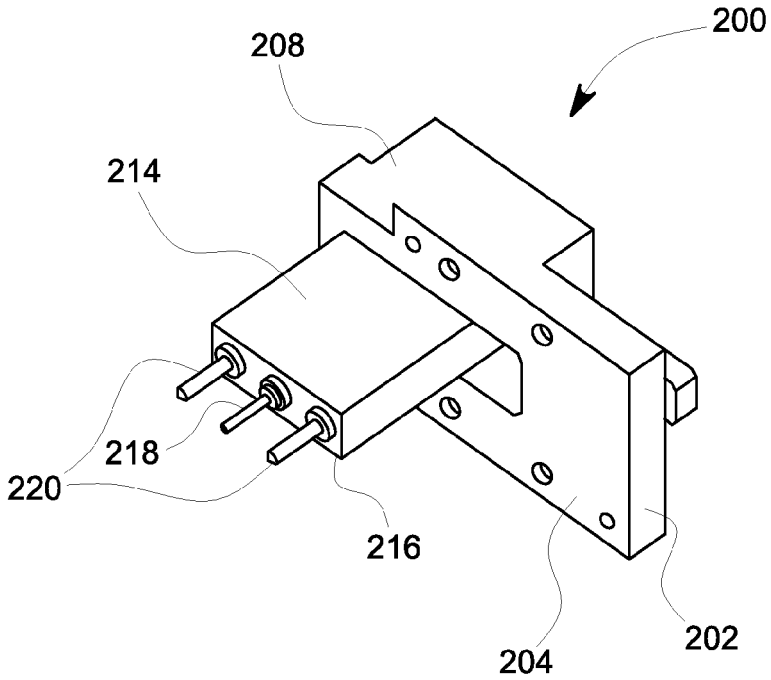
FIGS. 3 and 4 are perspective views of a locking device that may be used with the circuit breaker shown in FIGS. 1 and 2.
Figure 4:
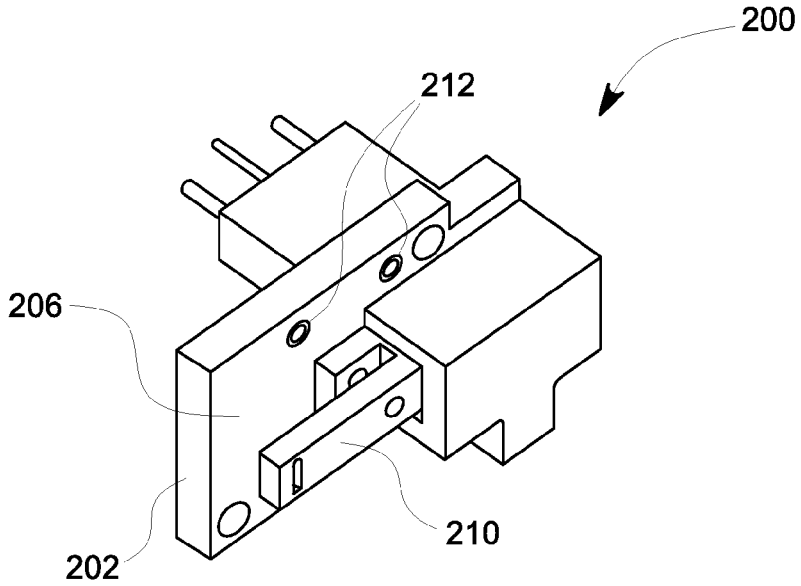
Figure 5:
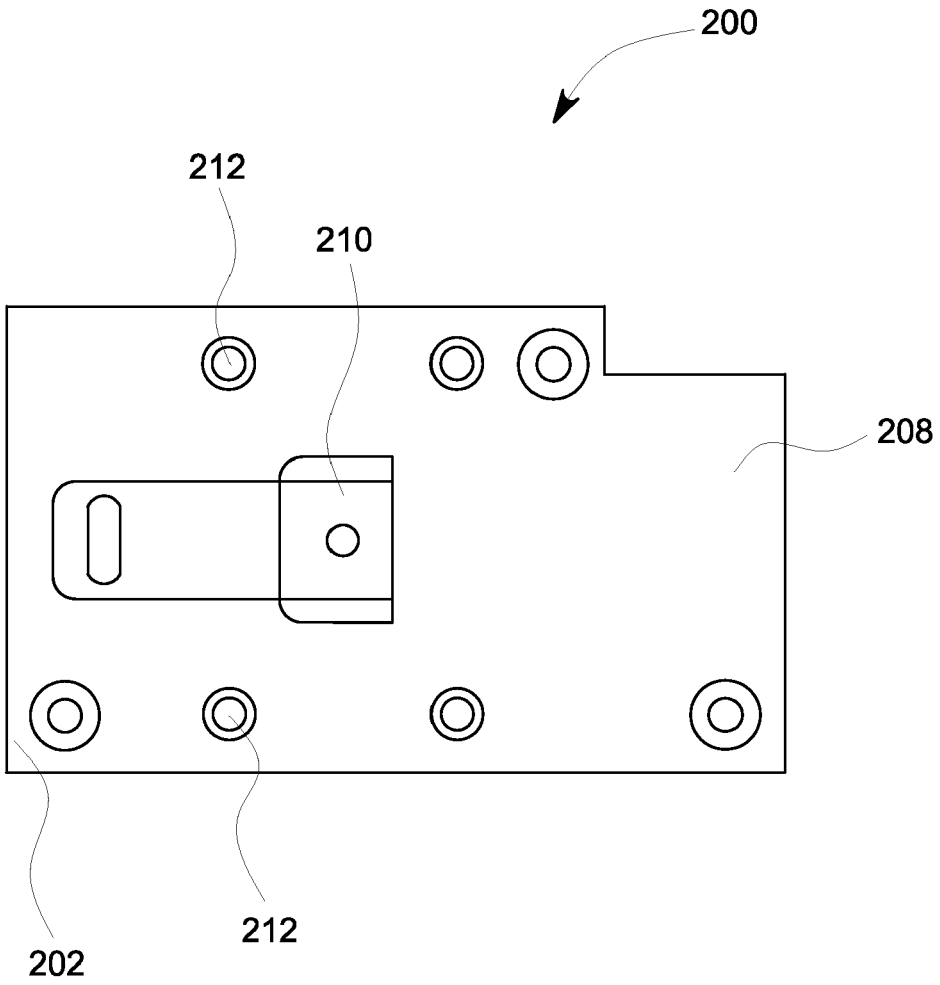
FIG. 5 is a front view of the locking device shown in FIGS. 3 and 4.
Figure 6:
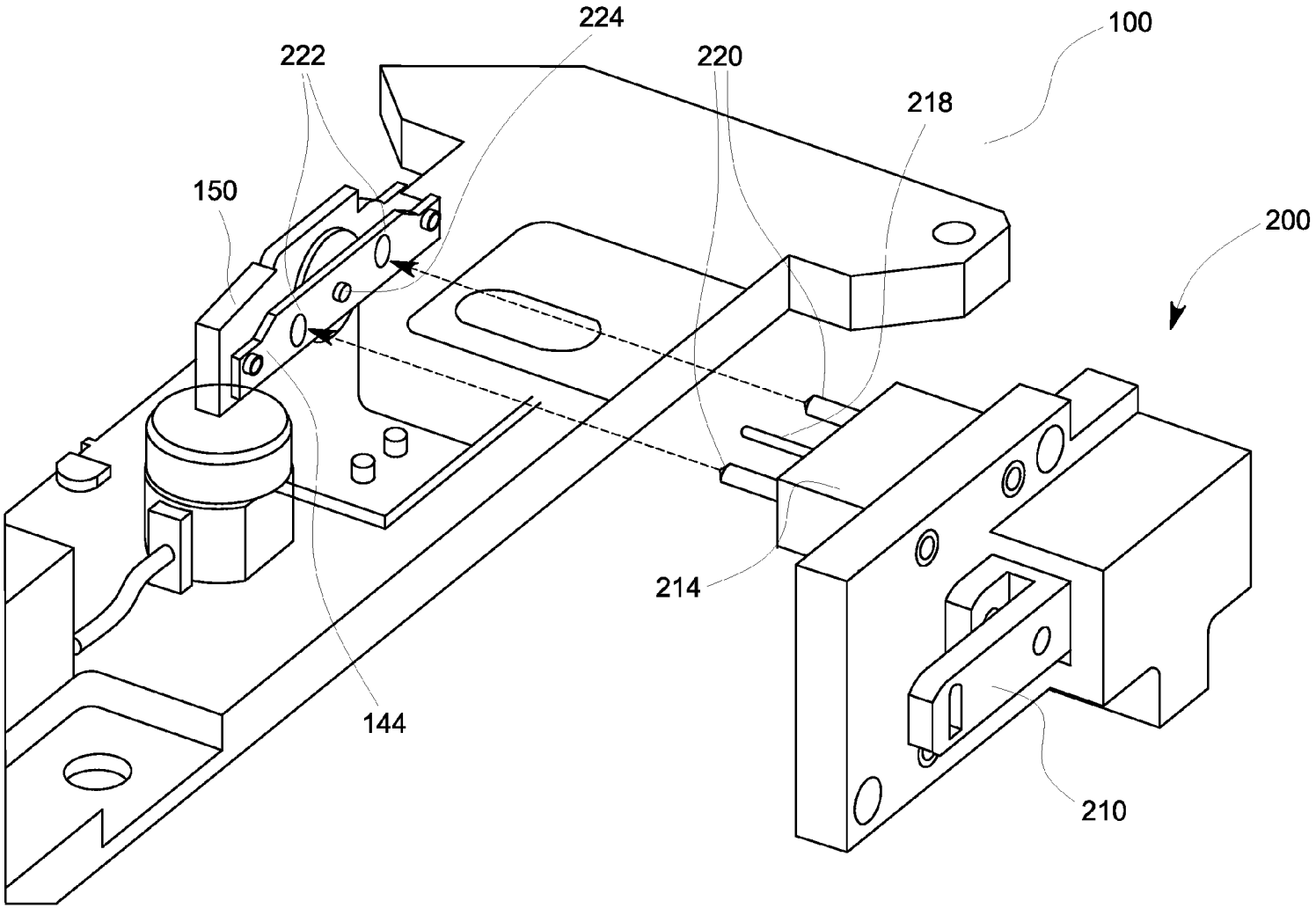
FIG. 6 is another perspective view of the locking device shown in FIGS. 3 and 4 and the circuit breaker shown in FIGS. 1 and 2.

FIGS. 3-6 are views of an exemplary locking device 200 for use with circuit breaker 102. Specifically, FIGS. 3 and 4 are perspective views of locking device 200 of circuit protection device 100, FIG. 5 is a front view of locking device 200, and FIG. 6 is a perspective view of locking device 200 and circuit breaker 102. In an exemplary embodiment, locking device 200 includes a main body 202 having an inner surface 204 and an opposite outer surface 206. A housing 208 is positioned along a portion of outer surface 206. In one embodiment, main body 202 and housing 208 are unitary or integrally formed. In another embodiment, main body 202 and housing 208 are coupled together. In an exemplary embodiment, a locking arm 210 extends out of housing 208 to receive an input from a user or from an automatic actuating device (not shown). The actuating device is coupled to main body 202 via a plurality of mounting apertures 212. For example, a plurality of pins or other fastening mechanisms of the actuating device are inserted into respective mounting apertures 212 to facilitate coupling the actuating device to main body 202.

Moreover, a rotor 214 extends from housing 208 through main body 202. Rotor 214 includes locking arm 210 at one end. A plurality of pins extends from an end surface 216 of rotor 214, including an axle pin 218 and two coupling pins 220. As shown in FIG. 6, lever 144 includes a plurality of openings each sized to receive a respective pin. For example, lever 144 includes two first openings 222 that are each sized to receive a respective coupling pin 220 therein, and a second opening 224 that is sized to receive axle pin 218 therein. Rotor 214 rotates about axle pin 218, thereby causing lever 144 to rotate about fourth pivot point 152 (shown in FIGS. 1 and 2), based on the input received via locking arm 210. Coupling pins 220 facilitate securing locking device 200 to circuit breaker 100.

Referring to FIGS. 3-6, and when first and second contact arms 104 and 114 (both shown in FIGS. 1 and 2) are in the closed state, an actuating force is received via locking arm 210. In an exemplary embodiment, the actuating force is an upward force induced on locking arm 210 by service personnel or by an actuating device. The actuating force causes locking arm 210 to rotate, such as rotating clockwise, to a trip position. The rotation of locking arm 210 translates to rotor 214, which also rotates. The rotation of rotor 214 similarly causes lever 144 to rotate about fourth pivot point 152, which is substantially aligned with axle pin 218. Moreover, the rotation of lever 144 causes tripping block 150 to contact second latch 136 (shown in FIGS. 1 and 2). For example, tripping block 150 induces an upward force on second latch 136 that causes second latch 136 to disengage from latch bolt 124 (shown in FIGS. 1 and 2). When second latch 136 and latch bolt 124 have disengaged, compression element 126 (shown in FIGS. 1 and 2) causes second contact arm 114 to move away from first contact arm 104. This motion causes first and second conductive contacts 112 and 120 (both shown in FIGS. 1 and 2) to separate, thereby breaking the electrical connection between them such that current can no longer flow through circuit breaker 102.

Furthermore, and in an exemplary embodiment, locking device 200 also facilitates locking circuit breaker 102 in the open state, wherein first and second contact arms 104 and 114 are separated. To maintain first and second contact arms 104 and 114 in the open position, locking arm 210 is maintained in the trip position. Maintaining locking arm 210 in the trip position also causes lever 144 to remain in its rotated position, which disengages, or prevents engagement of, second latch 136 and latch bolt 124 during a closing operation in which second contact arm 114 moves from the second position towards the first position. For example, if solenoid 140 (shown in FIGS. 1 and 2) initiates the closing operation that causes first and second contact arms 104 and 114 to close, tripping block 150 causes second latch 136 to disengage from latch bolt 124. Specifically, an edge of second latch 136 makes contact with an edge of tripping block 150, which causes second latch 136 to remain disengaged from latch bolt 124. Accordingly, compression element 126 continues to hold second contact arm 114 in the second position.

Figure 7:
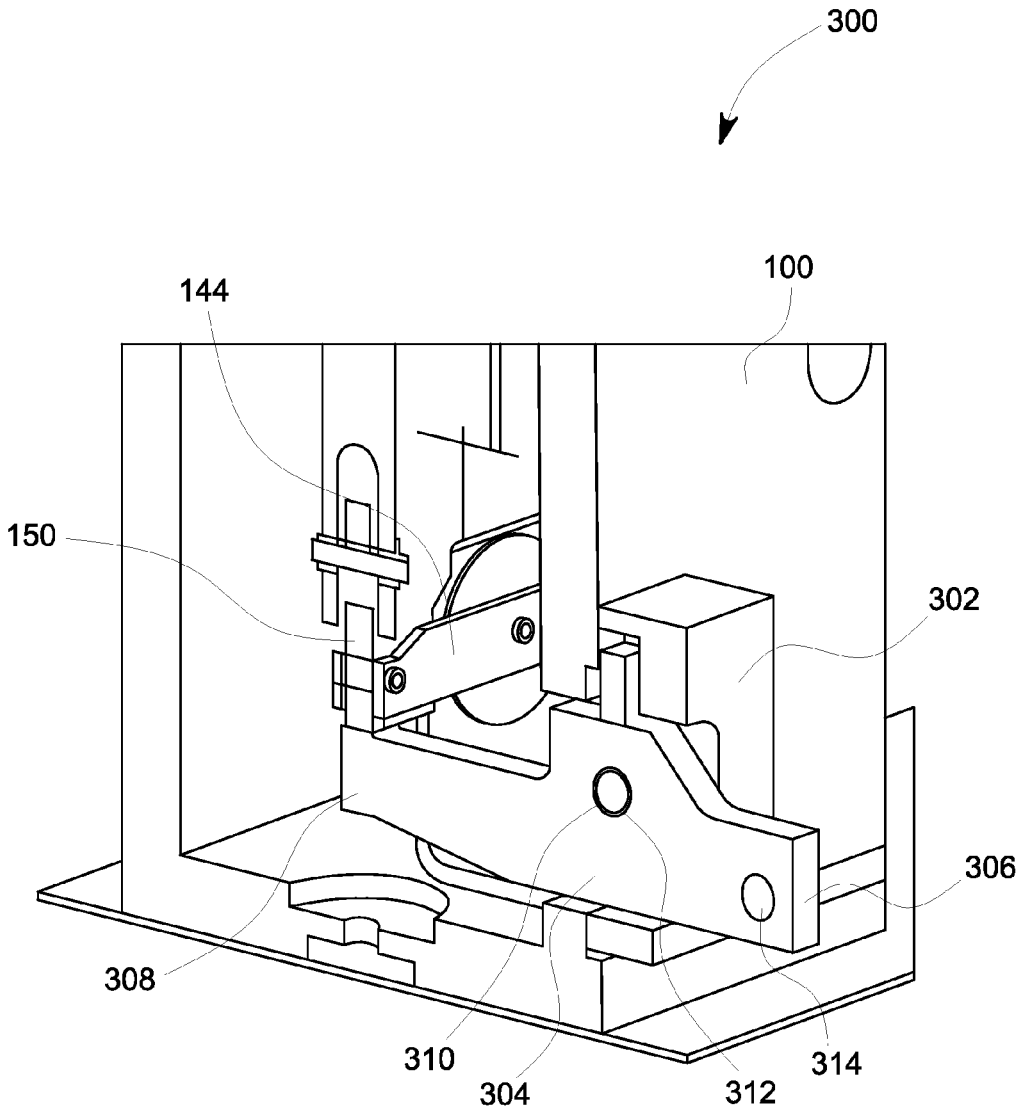
FIG. 7 is a view of an alternative locking device for use with the circuit breaker shown in FIGS. 1 and 2.

FIG. 7 is a view of an alternative locking device 300 for use with circuit breaker 102 of circuit protection device 100. In an exemplary embodiment, locking device 300 includes a housing 302 and a locking arm 304 that extends through housing 302 into circuit breaker 102. Locking arm 304 includes a first end 306 and an opposite second end 308. First end 306 extends outward from housing 302 away from circuit breaker 102 to receive an actuating force from service personnel or an actuating device. Second end 308 partially extends into circuit breaker 102 from housing 302 along a first axis and contacts tripping block 150. A retracting spring (not shown) is provided within housing 302 to facilitate returning arm 304 to its original position after receiving the actuating force. Moreover, locking arm 304 is coupled to housing 302 by a pin 310 that extends through a first opening 312 within locking arm 304. Locking arm 304 includes a second opening 314 that enables the actuating device to be coupled to locking device 300.

Locking device 300 enables service personnel or the actuating device to cause circuit breaker 102 to trip, or move first and second contact arms 104 and 114 (shown in FIGS. 1 and 2) from the closed position to the open position. Moreover, locking device 300 enables service personnel or the actuating device to lock first and second contact arms 104 and 114 in the open position. To move first and second contact arms 104 and 114 into the open position, the actuating force is a downward force on first end 306, which causes locking arm 304 to rotate about pin 310. Specifically, the actuating force causes locking arm 304 to rotate about a second axis that is substantially perpendicular to the first axis. The rotation of arm 304 causes second end 308 to induce an upward force on tripping block 150. The upward force causes tripping block 150 to induce an upward force on second latch 136 that causes second latch 136 to disengage with latch bolt 124 (shown in FIGS. 1 and 2). When second latch 136 and latch bolt 124 have disengaged, compression element 126 (shown in FIGS. 1 and 2) causes second contact arm 114 to move away from first contact arm 104. This motion causes first and second conductive contacts 112 and 120 (both shown in FIGS. 1 and 2) to separate, thereby breaking the electrical connection between them such that current can no longer flow through circuit breaker 102.

Figure 8:
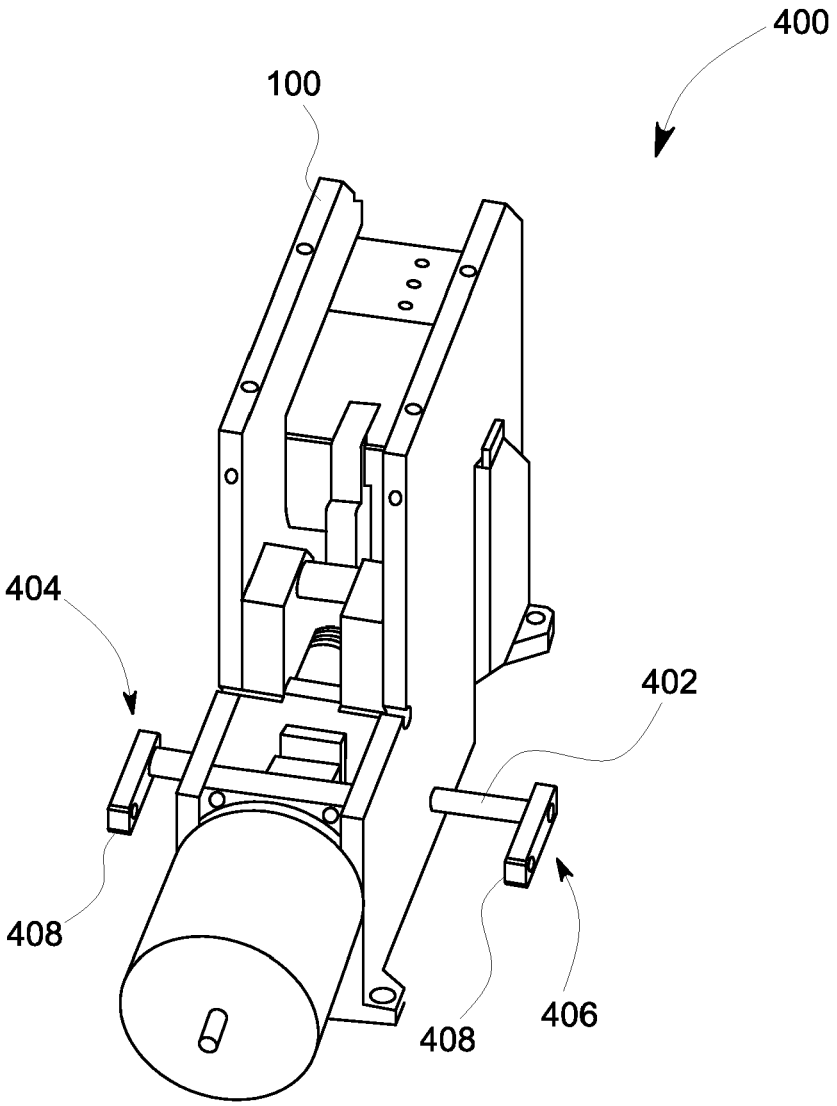
FIG. 8 is a view of another alternative locking device for use with the circuit breaker shown in FIGS. 1 and 2.
Figure 9:
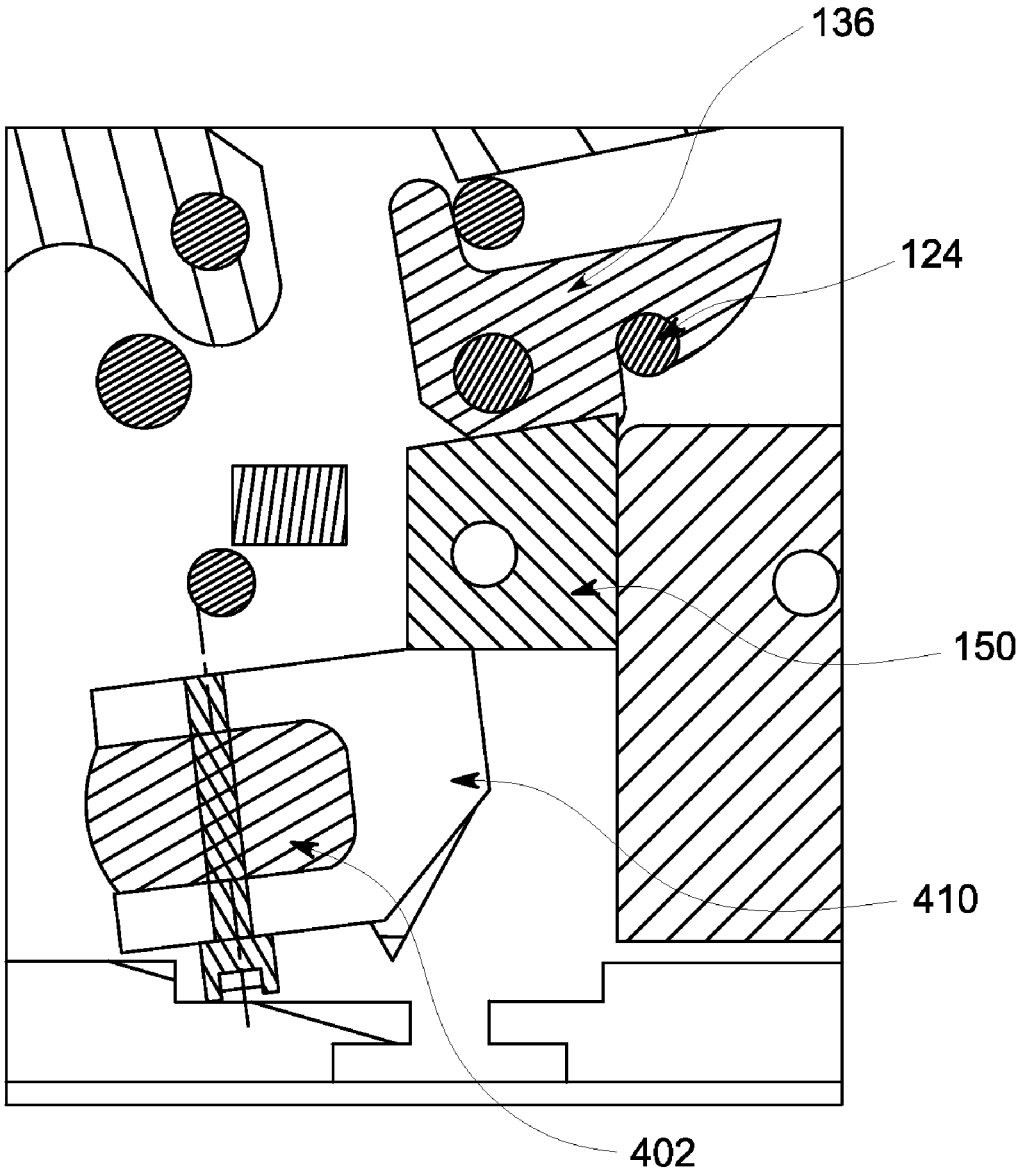
FIG. 9 is a cross-sectional view of the locking device shown in FIG. 8.

FIGS. 8 and 9 are views of another alternative locking device 400 for use with circuit breaker 102 of circuit protection device 100. As shown in FIG. 8, and in an exemplary embodiment, locking device 400 includes a shaft 402 that extends through circuit breaker 102. Shaft 402 includes a first end 404 and an opposite second end 406. An arm 408 is coupled to shaft 402 at each end 404 and 406. Providing multiple arms 408 facilitates orienting circuit breaker 102 in multiple operating environments. FIG. 9 is a cross-sectional view of circuit breaker 102 and locking device 400. As shown in FIG. 9, locking device 400 also includes a trip lever 410 that is coupled to shaft 402. When an actuating force is induced on either arm 408, shaft 402 rotates, which causes trip lever 410 to induce an upward force on tripping block 150. The force on tripping block 150 causes tripping block 150 to induce an upward force on second latch 136 that causes second latch 136 to disengage with latch bolt 124.

Exemplary embodiments of circuit protection devices, locking devices, and methods of assembling a circuit protection device having a circuit breaker and a locking device are described above in detail. The systems, methods, and apparatus are not limited to the specific embodiments described herein but, rather, operations of the methods and/or components of the apparatus and/or systems may be utilized independently and separately from other operations and/or components described herein. Further, the described operations and/or components may also be defined in, or used in combination with, other systems, methods, and/or apparatus, and are not limited to practice with only the systems, methods, and storage media as described herein.

Although the present invention is described in connection with an exemplary electrical equipment protection environment, embodiments of the invention are operational with numerous other general purpose or special purpose equipment protection environments or configurations. The equipment protection environment is not intended to suggest any limitation as to the scope of use or functionality of any aspect of the invention. Moreover, the equipment protection environment should not be interpreted as having any dependency or requirement relating to any one or combination of components illustrated in the exemplary operating environment.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

When introducing elements of aspects of the invention or embodiments thereof, the articles "a," "an," "the," and "said" are intended to mean that there are one or more of the elements. The terms "comprising," including," and "having" are intended to be inclusive and mean that there may be additional elements other than the listed elements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A circuit protection device comprising:

a circuit breaker comprising a first contact arm and a second contact arm, said second contact arm configured to move with respect to said first contact arm between a first position and a second position, wherein said second contact arm comprises a first end and a second end, said second end comprising a latch bolt, said circuit breaker further comprising a lever comprising a third end and a fourth end, said fourth end comprising a tripping block configured to disengage from said latch bolt; and a locking device coupled to said circuit breaker, said locking device configured to at least one of (a) move said second contact arm from the first position to the second position and (b) lock said second contact arm in the second position.

2. A circuit protection device in accordance with claim 1, wherein said lever further comprises a first opening, and said locking device comprises a first pin configured to be inserted into said first opening to couple said locking device to said circuit breaker.

3. A circuit protection device in accordance with claim 2, wherein said lever further comprises a second opening, said locking device further comprises a second pin configured to be inserted into said second opening.

4. A circuit protection device in accordance with claim 3, wherein said locking device further comprises a rotor comprising a locking arm, said first pin, and said second pin, said rotor configured to rotate about said second pin.

5. A circuit protection device in accordance with claim 1, wherein said locking device comprises a locking arm, said locking device is configured such that an actuating force on said locking arm causes said lever to rotate such that said tripping block disengages from said latch bolt.

6. A circuit protection device in accordance with claim 5, wherein said locking device is configured to be coupled to an automated tripping actuator configured to induce the actuating force on locking said arm.

7. A circuit protection device in accordance with claim 1, wherein said locking device comprises a locking arm configured to be inserted at least partially into said circuit breaker along a first axis, said locking device is configured such that an actuating force on said locking arm causes said locking arm to rotate about a second axis that is perpendicular to the first axis and causes said lever to rotate such that said tripping block disengages from said latch bolt.

8. A circuit protection device in accordance with claim 1, wherein said circuit breaker further comprises a first side and a second side, said locking device comprises a respective locking arm positioned on each of said first side and said second side.

9. A locking device for use with a circuit breaker that includes at least one movable contact arm configured to move between a first position and a second position, said locking device comprising:

a housing comprising an opening extending therethrough; and a rotor configured to be coupled to said housing and to the circuit breaker, said rotor configured to rotate about an axis, said rotor comprising a locking arm extending through the opening such that an actuating force on said locking arm causes the at least one contact arm to perform at least one of (a) locking in the second position and (b) moving from the first position to the second position.

10. A locking device in accordance with claim 9, further comprising a first pin configured to couple said locking device to the circuit breaker.

11. A locking device in accordance with claim 10, further comprising a second pin configured to couple said locking device to the circuit breaker, said rotor configured to rotate about said second pin.

12. A locking device in accordance with claim 11, wherein the actuating force on said locking arm causes said rotor to rotate about said second pin such that said first pin causes the at least one contact arm to perform at least one of (a) locking in the second position and (b) moving from the first position to the second position.

13. A locking device in accordance with claim 9, wherein said locking arm is configured to be inserted at least partially into the circuit breaker along a first axis, said locking device is configured such that the actuating force on said locking arm causes the at least one contact arm to perform at least one of (a) locking in the second position and (b) moving from the first position to the second position.

14. A locking device in accordance with claim 9, wherein said locking device is configured to be coupled to an automated tripping actuator configured to induce the actuating force on said locking arm.

15. A locking device in accordance with claim 9, wherein the circuit breaker further includes a first side and a second side, said locking device comprises a locking arm positioned on each of the first side and the second side.

16. A method of assembling a circuit protection device, said method comprising:

providing a circuit breaker having a first contact arm and a second contact arm that is configured to move with respect to the first contact arm between a first position and a second position, wherein the second contact arm includes a first end and a second end, the second end having a latch bolt, the circuit breaker further including a lever having a third end and a fourth end, the fourth end including a tripping block configured to disengage from the latch bolt; and coupling a locking device to the circuit breaker, the locking device configured to cause the second contact arm to at least one of (a) move from the first position to the second position and (b) lock the second contact arm in the second position.

17. A method in accordance with claim 16, wherein coupling a locking device to the circuit breaker comprises inserting a first pin of the locking device into a corresponding first opening of the circuit breaker to couple the locking device to the circuit breaker.

18. A method in accordance with claim 17, wherein coupling a locking device to the circuit breaker further comprises inserting a second pin of the locking device into a second opening of the circuit breaker.

19. A method in accordance with claim 17, wherein coupling a locking device to the circuit breaker further comprises orienting a locking arm of the locking device such that an actuating force on the locking arm causes the locking device to cause the second contact arm to at least one of (a) move from the first position to the second position and (b) lock the second contact arm in the second position.

* * * * *

UNITED STATES PATENT AND TRADEMARK OFFICE

CERTIFICATE OF CORRECTION

PATENT NO. : 8,395,063 B2
APPLICATION NO. : 12/980888
DATED : March 12, 2013
INVENTOR(S) : Lagiewka et al.

It is certified that error appears in the above-identified patent and that said Letters Patent is hereby corrected as shown below:

In the Specifications:

In Column 4, Line 30, delete "projection 160" and insert -- projection 162 --, therefor.

Signed and Sealed this
Thirtieth Day of April, 2013

Teresa Stanek Rea
*Acting Director of the United States Patent and Trademark Office*